US006571545B2

(12) United States Patent
Premi

(10) Patent No.: US 6,571,545 B2
(45) Date of Patent: Jun. 3, 2003

(54) DEVICE FOR THE PNEUMATIC SPLICING OF THREADS OR YARNS AND A PROCESS TO CARRY OUT SUCH SPLICING

(75) Inventor: Mauro Premi, Brescia (IT)

(73) Assignee: Mesdan S.p.A., Brescia (IT)

( * ) Notice: Subject to any disclaimer, the term of this patent is extended or adjusted under 35 U.S.C. 154(b) by 28 days.

(21) Appl. No.: 09/729,764

(22) Filed: Dec. 5, 2000

(65) Prior Publication Data

US 2001/0003894 A1 Jun. 21, 2001

(30) Foreign Application Priority Data

Dec. 15, 1999 (IT) ..... MI99A2595

(51) Int. Cl.[7] ..... B65H 69/06
(52) U.S. Cl. ..... 57/22; 57/202
(58) Field of Search ..... 57/22, 23, 202, 57/261, 262, 263, 352, 353, 356, 357; 28/209, 210, 141

(56) References Cited

U.S. PATENT DOCUMENTS 4,630,433 A * 12/1986 Premi ..... 57/22

FOREIGN PATENT DOCUMENTS

DE 3540324 A1 * 12/1986

* cited by examiner

*Primary Examiner*—John J. Calvert
*Assistant Examiner*—Shaun R Hurley
(74) *Attorney, Agent, or Firm*—Hedman & Costigan, P.C.

(57) ABSTRACT

A device for the pneumatic splicing of threads or yarns which includes a splice box (11), equipped with lateral outlet edges (12, 13) and an upper lengthwise slot (30) through which the thread ends (14, 15) are introduced into the splice box (11) and into which it is possible to blow in pressurized air. The device includes means to open and close, at least partially, the lateral outlet edges (12, 13) so as to be able to carry out an initial introduction of at least one blast of compressed air into the splice box (11) when the lateral outlet edges (12, 13) are mostly closed, and a second introduction of at least one blast of compressed air into the splice box (11) when the lateral outlet edges (12, 13) are mostly or completely open. Besides, the present invention has, as its aim, a process for the pneumatic splicing of threads or yarns.

5 Claims, 3 Drawing Sheets

DEVICE FOR THE PNEUMATIC SPLICING OF THREADS OR YARNS AND A PROCESS TO CARRY OUT SUCH SPLICING

BACKGROUND OF THE INVENTION

The present invention has, as its aim, a device for the pneumatic splicing of threads or yarns.

Furthermore, the present invention has, as its aim, a process for the pneumatic splicing of threads or yarns. Compressed air devices for splicing textile yarns are known, commonly referred to as air splicers. The qualitative result of the compressed air splicing of threads is defined by tensile stress resistance and appearance, both comparable to the corresponding thread.

It is clear that the closer the similarity of resistance and appearance to the corresponding thread, the better the splice.

In particular, the known splicing devices have guides to assist the introduction of the threads, clamping and cutting members for the same threads, preparation members for the thread ends, withdrawal members for the cut threads in the direction of the splice box, and a splice box made in a casing and equipped with a through lengthwise slot for the introduction and extraction of threads, in which emerge one or more compressed air feed holes or nozzles.

The splice box also has lateral outlet edges for the discharge of pressurized air.

The following is a typical operating sequence for devices of this kind: introduction into the device of the thread ends to be spliced, the clamping and cutting of threads, opening of the thread ends using compressed air to remove the twist, withdrawal of the ends in the direction of the box.

At this point, one or more blasts of compressed air are introduced into the splice box to carry out the proper splicing.

Lastly, the spliced thread is released and all the members return to their initial position.

In the above defined splice box, the presence of one or more entry nozzles and the shape of the box itself allow the compressed air to be appropriately directed to perform the splice.

Considering, in more detail, the action of the compressed air on the thread fibres to be spliced, it is noted that this performs an interweaving or mixing action and a winding action of the fibres with each other.

These two effects are basically present simultaneously in the majority of box shapes used. However, depending on the box sections and the position of the jet nozzles, either the interweaving or the winding action may be prevalent.

For a better understanding of the phenomenon described it should be noted that, for splice quality the greater the interweaving or joining effect and resistance to tensile stress, the greater is the winding effect and the better is the appearance of the splice itself.

Moreover, there are yarns which have a propensity for greater interweaving (usually tough, long fibre yarns) and yarns which have a propensity for more winding (usually short fibre yarns, also known as cotton cut).

It has been found that a different position of the jet nozzles can be used, in the same box section, to obtain both the interweaving as well as the winding effect.

Therefore a patent application has been filed which puts the above principle into practice, by using two different ducts to transport the air to different nozzles and with two blasts of compressed air at successive times (one for each duct).

A more effective variant, described in the patent IT 1.251.856, envisages a double sectioned box: a central V-shaped section helps mixing, into which a nozzle emerges with a special duct and a circular type section at the two ends, with two suitably directed nozzles, one at each end, with their shared duct, to help the winding of the fibres with each other.

Air flow in the two ducts is started at different, subsequent moments.

The practical effect is the possibility to use the same box for different yarn types and therefore make the device more suitable for industrial use, without having to replace any parts (the splice box) in order to be able to splice different yarn types.

Nevertheless, both the suggested solutions, which are mentioned above, though valid, are the result of a compromise between sections and/or feed nozzles of compressed air in the box and have not produced wholly satisfactory results on a large number of textile yarns.

SUMMARY OF THE INVENTION

Therefore, the aim of the present invention is to produce a device for the pneumatic splicing of threads or yarns which produces excellent resistance and a splice which is very similar in appearance to that of the reference yarn and so for a greater number of yarn types, compared to previous suggested solutions.

Another aim of the present invention is to produce a splicing device which can save a considerable amount of time, eliminating unnecessary machine stops for the replacement of the splice box.

Another aim of the present invention is to produce a simple and economic splicing device.

These and other aims are reached by a device for pneumatic splicing of threads or yarns, including one splice box, equipped with lateral outlet edges and with an upper lengthwise slot, through which thread ends are introduced into said splice box and through which it is possible to blow in pressurized air into said splice box, further comprising means to open and close, at least partially, said lateral outlet edges so as to be able to carry out an initial introduction of at least one blast of compressed air into said splice box when said lateral outlet edges are mostly closed, and a second introduction of at least one blast of air into said splice box when the lateral outlet edges are mostly or completely open.

Moreover, such aims are reached by a process for pneumatic splicing of threads or yarns, including, in sequence, at least the following stages: the introduction into a splice box, belonging to a splicing device, of said thread ends to be spliced together; clamping and cutting of said threads; detwisting and opening of thread ends using compressed air and withdrawal of the ends in the direction of the splice box; an initial introduction of at least one blast of compressed air into said splice box when it is mostly closed at its lateral outlet edges, in order to help mixing; the opening of the lateral outlet edges; a second introduction of at least one blast of compressed air into said splice box when this is at least partially open at the lateral outlet edges, in order to help winding, release of the spliced thread and the return of all members to their original position.

In addition, further characteristics of the present invention are defined in the following claims.

BRIEF DESCRIPTION OF THE DRAWINGS

Further aims and advantages of the present invention will become apparent from the description that follows and from the enclosed designs, supplied simply as explanatory, non-limiting examples, in which.

DETAILED DESCRIPTION OF THE INVENTION

Figure 1:
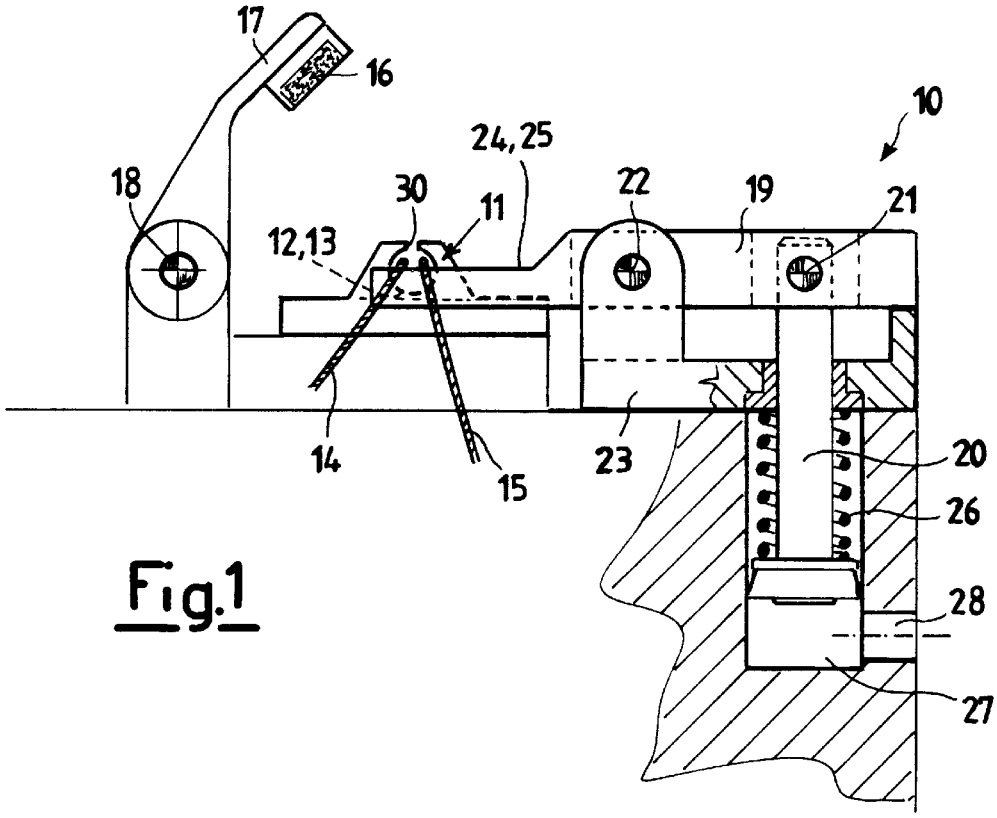
FIG. 1 shows a partially sectioned view of a device for the pneumatic splicing of threads or yarns, according to the present invention, in an initial operating position.
Figure 2:
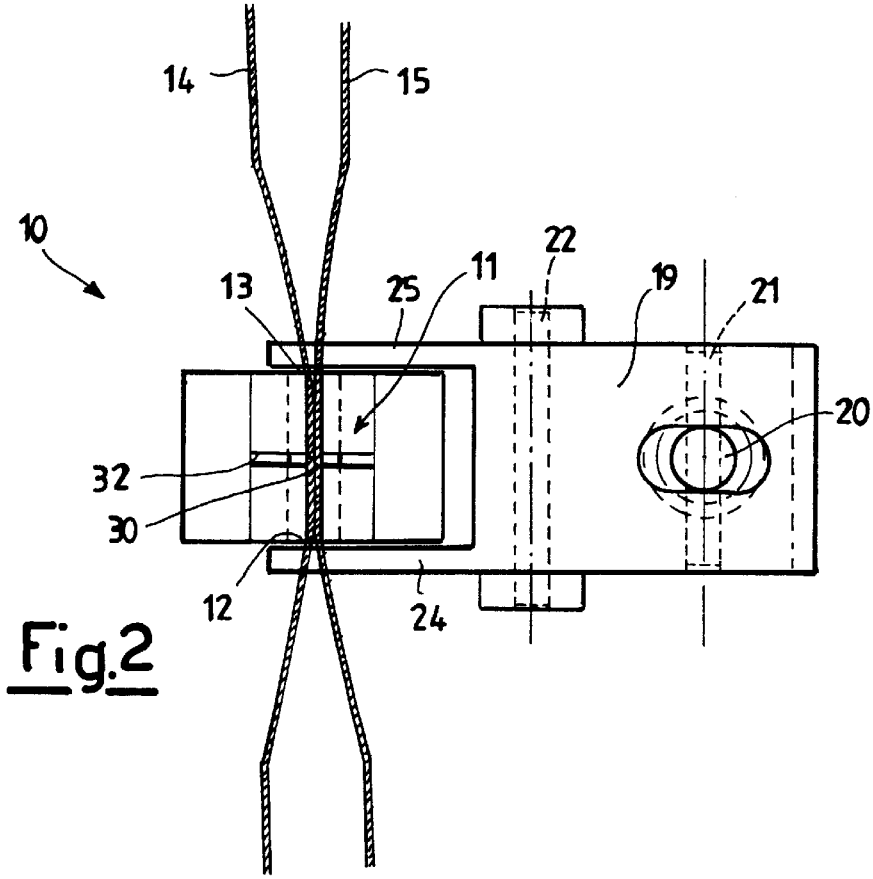
FIG. 2 shows a top view of the device in FIG. 1, in an initial operating position.

With particular reference to the figures mentioned, the device for the pneumatic splicing of threads or yarns, according to the present invention, is comprehensively denoted by reference number 10.

In such device 10, there is a splice box 11, with lateral outlet edges 12 and 13 through which are introduced the thread ends 14 and 15 to be spliced together.

The splice box 11 has an upper lengthwise slot 30 which may be closed above by a cover 16, assembled on a first arm 17 movable around a hinge 18.

In addition, the device 10 has a second arm 19 which is driven by a piston 20, to which it is joined by a hinge 21.

The second arm 19 can turn round a fulcrum 22, fixed to a support 23, and ending in two rods 24 and 25.

The piston 20 is joined to a spring 26 and to a box 27 for the entry of pressurized air, equipped with an air inlet 28 and air outlet (not shown).

The functioning of the pneumatic splicing device is briefly described as follows.

First of all, the thread ends 14 and 15 to be spliced together are introduced into the splice box 11 of the device 10.

Figure 3:
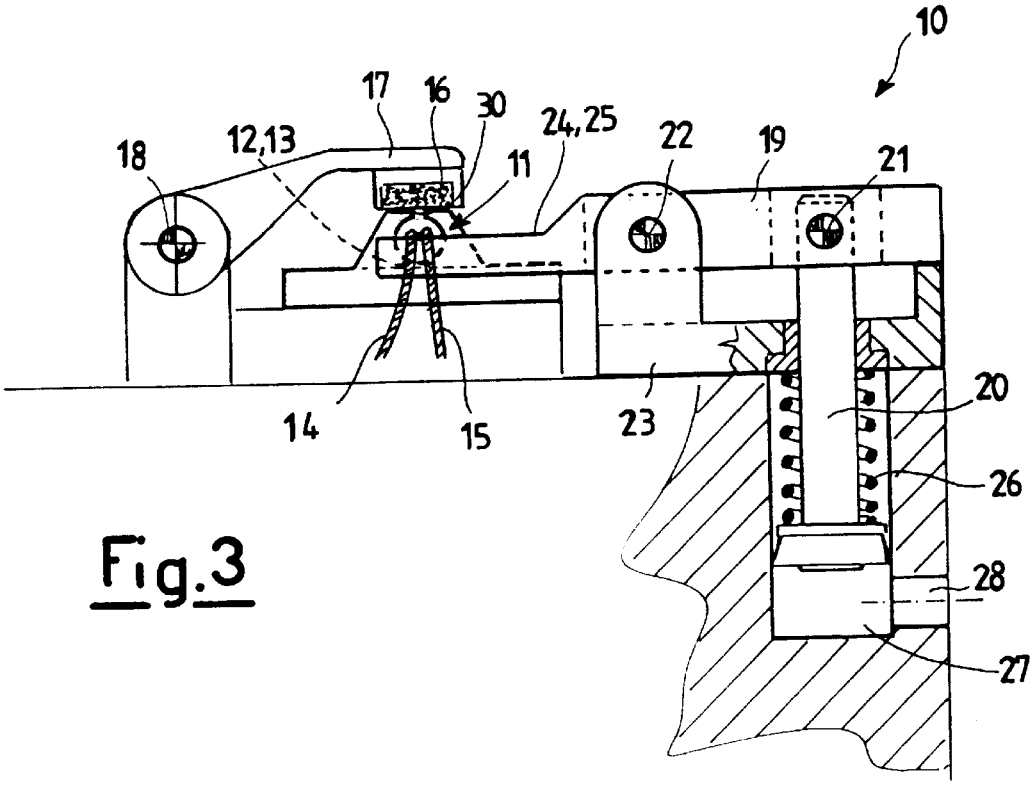
FIG. 3 shows a partially sectioned view of the device in FIG. 1 in a second operating position.
Figure 4:
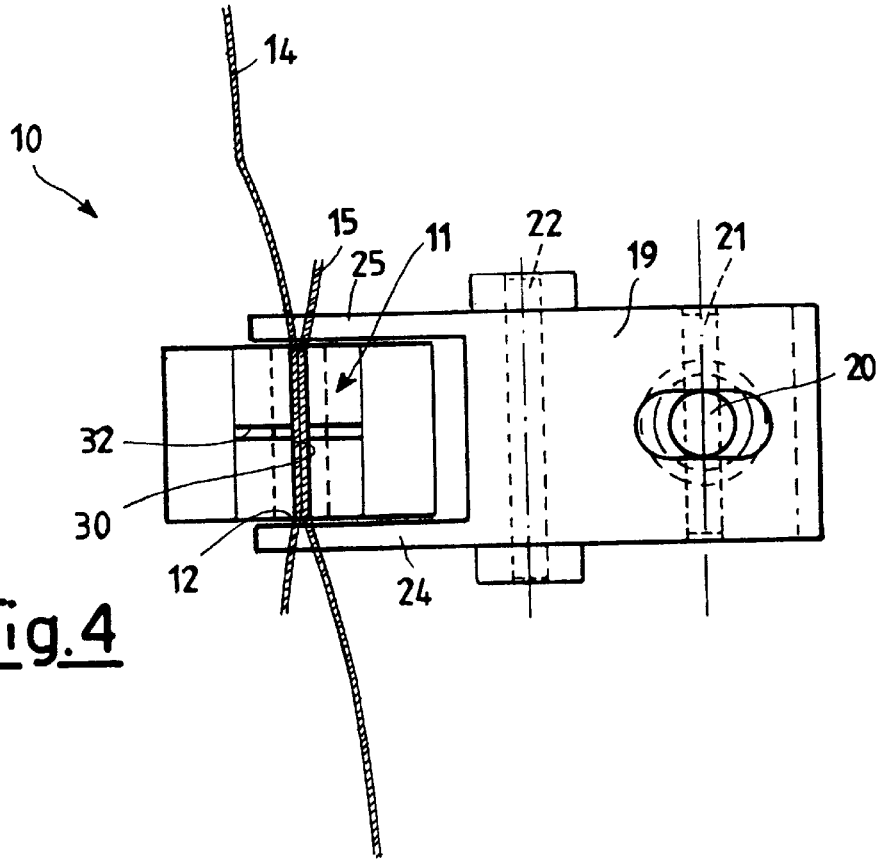
FIG. 4 shows a top view of the device in FIG. 2, in a second operating position.
Figure 5:
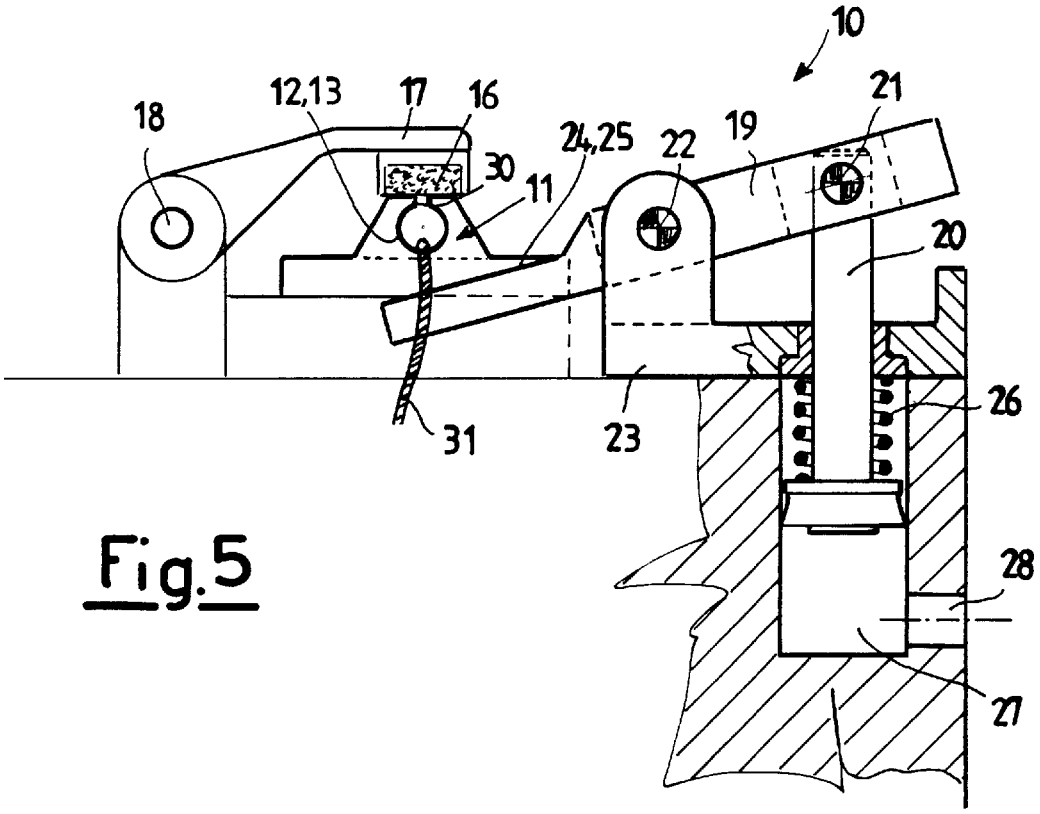
FIG. 5 shows a partially sectioned view of the device in FIG. 1 in a third operating position.

Then the splice box 11 and, in particular, the upper lengthwise slot 30 is closed by the cover 16 which, due to the downward movement of the first arm 17, assumes the closed position as in FIG. 3 and the threads are clamped and cut by clamps and shears, known in themselves and thus not shown.

Therefore the thread ends are opened using compressed air which causes their detwisting and the thread ends 14 and 15 are pulled back in the direction of the splice box 11.

At this point an initial introduction of one or more suitably timed blasts of compressed air is made into the splice box 11, which is partly closed at the lateral outlet edges 12 and 13, by the rods 24 and 25 belonging to the second arm 19.

This initial introduction of compressed air is carried out to help mixing.

Afterwards, the lateral outlet edges 12 and 13 of the splice box 11 are completely opened by the raising of the second arm 19, with the aid of the pneumatically operated piston 20.

The splice box 11, can be equipped with a central transverse slot 32 to allow the air introduced to escape.

As an alternative or in addition, this central transverse slot 32 can be made on the cover 16.

With this arrangement of the splice box 11, a second introduction of one or more suitably timed blasts of compressed air into the splice box is made, which is open at the lateral outlet edges 12 and 13.

This second introduction of compressed air is carried out to help the winding.

Figure 6:
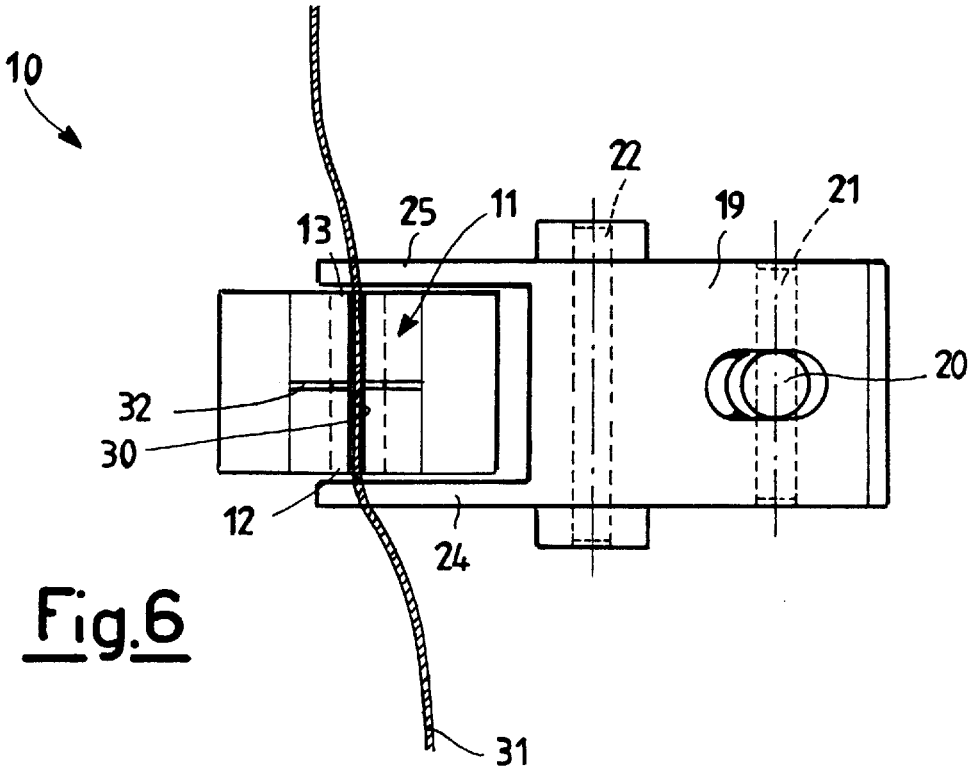
FIG. 6 shows a top view of the device in FIG. 2, in a third operating position.

Lastly, the thread thus spliced, is released, denoted by reference number 31 in FIG. 6, and all the members return to their initial position.

Therefore, with the described device 10, by using the same splice box 11 which, in itself, helps the winding effect, it action may be changed and used to help mixing, when it is appropriately and mostly closed at its lateral outlet edges 12 and 13, by means of the invention device.

Therefore the device may be used to obtain a double effect, first mixing and then winding, with the described splicing device and process.

This solution has been shown to be of considerable efficacy and adaptability, allowing excellent resistance and a splice which is very similar in appearance to the reference yarn and this being so for a greater number of yarns compared to the first suggested solutions, giving the user the considerable advantage of not having to replace the splice box for the processing of different yarns.

This operation involves a notable expenditure of time and machine stops, especially on automatic spoolers which are equipped with a large number of heads (up to 60) and thus splicers.

Moreover, in the case of high torsion yarns or irregular yarns which require a vigorous interweaving (or mixing) action to obtain a sufficiently resistant splice, the splice appearance is considerably improved by the subsequent winding blast, making the same practically imperceptible in the final fabric.

The solution described here is also much more economical and practical since, it works with just one compressed air duct and one delivery valve of the same, just by changing the operating sequence and using a movable member to close or open the lateral outlet edges of the box.

The advantage of just one air duct is increased by the fact that, due to reduced box dimensions, it is difficult to make two distinct ducts to separate the blasts of compressed air.

A variation of the splicing process of the invention consists, first of all, in carrying out the preliminary operations already described: the introduction of the thread ends 14 and 15 to be spliced together, into a splice box 11; closing of the upper longitudinal slot 30; clamping and cutting of threads and the opening of the thread ends using compressed air to cause their detwisting and the withdrawal of the thread ends 14 and 15 in the direction of the splice box 11.

At this point, compressed air is introduced into the splice box 11, which is partly closed at the lateral outlet edges 12 and 13, by the rods 24 and 25 belonging to the second arm 19.

This introduction of compressed air into the splice box 11 is suitably timed for a sufficient length of time.

Still during the first introduction of compressed air, at a certain point, the lateral outlet edges 12 and 13 of the splice box are completely opened by raising the second arm 19, with the aid of the pneumatically operated piston 20.

Lastly, the spliced thread is released and all the members return to their initial position.

The description makes the device and process characteristics clear for the pneumatic splicing of threads or yarns, which are the subject of the present invention, with its advantages being likewise apparent.

Finally, it is clear that numerous variations can be made to the device and process for the pneumatic splicing of threads or yarns, subject of the present invention, without leading away from the innovative principles of the invention.

In the practical implementation of the invention, any materials, forms and dimensions of the details illustrated may be replaced with other technically equivalent ones.

What is claimed is:

1. A device (10), for the pneumatic splicing of threads or yarns, including one splice box (11), equipped with lateral outlet edges (12, 13) and with an upper lengthwise slot (30), through which said thread ends (14, 15) are introduced into said splice box (11) and through which pressurized air is blown into said splice box (11), further comprising means to partially close and open said lateral outlet edges (12, 13) so as to be able to carry out an initial introduction of at least one blast of compressed air into said splice box (11) when said lateral outlet edges (12, 13) are partially closed, and a second introduction of at least one blast of compressed air into said splice box (11) when the lateral outlet edges (12, 13) are completely open; wherein the means to open and close said lateral outlet edges (12, 13) of the splice box (11) has an arm (19), which is rotary operated and ends in two rods (24, 25) that intercept, at least partially, said lateral outlet edges (12, 13).

2. A device (10), according to claim 1, wherein said arm (19) is operated by a piston (20), to which it is joined by a hinge (21), which turns around a fulcrum (22) which is fixed to a support (23) and said piston being connected to a spring (26) to return said arm (19) back into position.

3. A device (10), for the pneumatic splicing of threads or yarns, including one splice box (11), equipped with lateral outlet edges (12, 13) and with an upper lengthwise slot (30), through which said thread ends (14, 15) are introduced into said splice box (11) and through which pressurized air is blown into said splice box (11), further comprising means to partially close and open said lateral outlet edges (12, 13) so as to be able to carry out an initial introduction of at least one blast of compressed air into said splice box (11) when said lateral outlet edges (12, 13) are partially closed, and a second introduction of at least one blast of compressed air into said splice box (11) when the lateral outlet edges (12, 13) are completely open; wherein a central transverse slot (32) is made on a cover (16).

4. A process for the pneumatic slicing of threads or yarns, including, in sequence, at least the following stages: the introduction into a splice box (11), belonging to a splicing device (10), of said thread ends (14, 15) to be spliced together; clamping and cutting of said threads (14, 15); detwisting and opening of thread ends using compressed air and withdrawal of the ends in the direction of the splice box (11); an initial introduction of at least one blast of compressed air into said splice box (11) when it is partially closed at its lateral outlet edges (12, 13), in order to help mixing; the opening of the lateral outlet edges (12, 13); a second introduction of at least one blast of compressed air into said splice box (11) when this is completely open at the lateral outlet edges (12, 13), in order to help winding, release of the spliced thread (31) and the return of all members to their initial position.

5. A process for the pneumatic slicing of threads or yarns, including, in sequence, at least the following stages: the introduction into a splice box (11) having an upper longitudinal slot, thread ends (14, 15) to be spliced together; closing of the upper longitudinal slot (30); clamping and cutting of said threads (14, 15); detwisting and opening of thread ends using compressed air and withdrawal of the ends in the direction of the splice box (11); the introduction of suitably timed compressed air for a sufficient length of time into said splice box (11), which is partly closed at the lateral outlet edges (12, 13); the opening, during this introduction of compressed air, of the lateral outlet edges (12, 13) of said splice box (11); the release of the spliced thread (31) and the return of all members to their initial position.

* * * * *